US009108829B2

(12) United States Patent
Hynous et al.

(10) Patent No.: US 9,108,829 B2
(45) Date of Patent: Aug. 18, 2015

(54) CASING SECTION LIFT AND TRANSPORT SYSTEM

(75) Inventors: Andrew Thomas Hynous, Greenville, SC (US); John William Herbold, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 1287 days.

(21) Appl. No.: 12/964,312

(22) Filed: Dec. 9, 2010

(65) Prior Publication Data

US 2012/0145976 A1 Jun. 14, 2012

(51) Int. Cl.
*B66F 3/08* (2006.01)

(52) U.S. Cl.
CPC ..... *B66F 3/08* (2013.01)

(58) Field of Classification Search
CPC ..... B66F 9/00; B66F 7/16; B66F 7/12; B66F 3/08
USPC ..... 254/98, 100–103, 93 R, 89 HP
See application file for complete search history.

(56) References Cited

U.S. PATENT DOCUMENTS

| | | | | |
|---|---|---|---|---|
| 4,375,934 | A * | 3/1983 | Elliott | 414/11 |
| 4,914,940 | A * | 4/1990 | Hebert | 72/392 |
| 5,087,019 | A * | 2/1992 | Peabody et al. | 254/100 |
| 6,394,405 | B1 * | 5/2002 | Roxton et al. | 248/354.1 |
| 6,916,013 | B2 * | 7/2005 | Cardona | 254/93 R |
| 8,448,317 | B2 * | 5/2013 | Fra | 29/244 |
| 2006/0022179 | A1 * | 2/2006 | Oh | 254/98 |
| 2012/0145976 | A1 * | 6/2012 | Hynous et al. | 254/98 |
| 2012/0193591 | A1 * | 8/2012 | Huang | 254/100 |

* cited by examiner

*Primary Examiner* — Lee D Wilson

(57) ABSTRACT

A machine casing section lift system includes a first attachment member configured to attach to a machine casing section, the first attachment member including a first jacking mechanism connection portion. The system also includes a second attachment member configured to attach to a lower casing section that, in operation, is positioned below the machine casing section, the second attachment member including a second jacking mechanism connection portion. The system also includes a jacking mechanism to raise the machine casing section and having a collar configured to couple with the first jacking mechanism connection portion and a base configured to rest in the second jacking mechanism connection portion.

20 Claims, 5 Drawing Sheets

CASING SECTION LIFT AND TRANSPORT SYSTEM

BACKGROUND OF THE INVENTION

The subject matter disclosed herein relates to industrial equipment such as turbines, generators, motors, compressors and other industrial equipment that requires lifting and/or transporting a casing section.

A typical piece of industrial equipment, for example a turbine employed in the production of electrical power, includes one or more rotating blades surrounded by an outer casing. Such turbines operate in an acceptable manner in most instances. As with other mechanical devices, the turbine may need periodic or specific maintenance.

In some cases, the maintenance requires that a portion of the outer casing be removed to allow access interior portions of the turbine. Typically this requires utilizing a crane to remove the portion of the outer casing. However, utilizing a crane also requires that a portion of the roof of the enclosure housing the turbine be removed to allow the crane to access the casing. The removal of the roof and the cost of utilizing a crane can increase the costs and manpower demands of the maintenance. When maintenance needs to be performed in the case of a turbine failure, the time required to provide for crane access also becomes important. Furthermore, in some regions it may be too cold to perform the required maintenance with an open roof. In such cases, the required maintenance may be postponed causing revenue loss, or at minimum, increased costs related to heating the work area.

BRIEF DESCRIPTION OF THE INVENTION

According to one aspect of the invention, a machine casing section lift system is disclosed. The system of this aspect includes a first attachment member configured to attach to a machine casing section, the first attachment member including a first jacking mechanism connection portion. The system of this aspect also includes a second attachment member configured to attach to a lower casing section that, in operation, is positioned below the machine casing section, the second attachment member including a second jacking mechanism connection portion. The system of this aspect also includes a jacking mechanism to raise the machine casing section and having a collar configured to couple with the first jacking mechanism connection portion and a base configured to rest in the second jacking mechanism connection portion.

According to another aspect of the invention, a machine casing section transport system is disclosed. The system of this aspect includes one or more vertical supports configured to couple to a section of a machine, a travel beam supported by the one of the vertical supports and a first attachment member configured to couple to a first casing section of the machine and including a translation assembly that allows it to traverse the travel beam.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
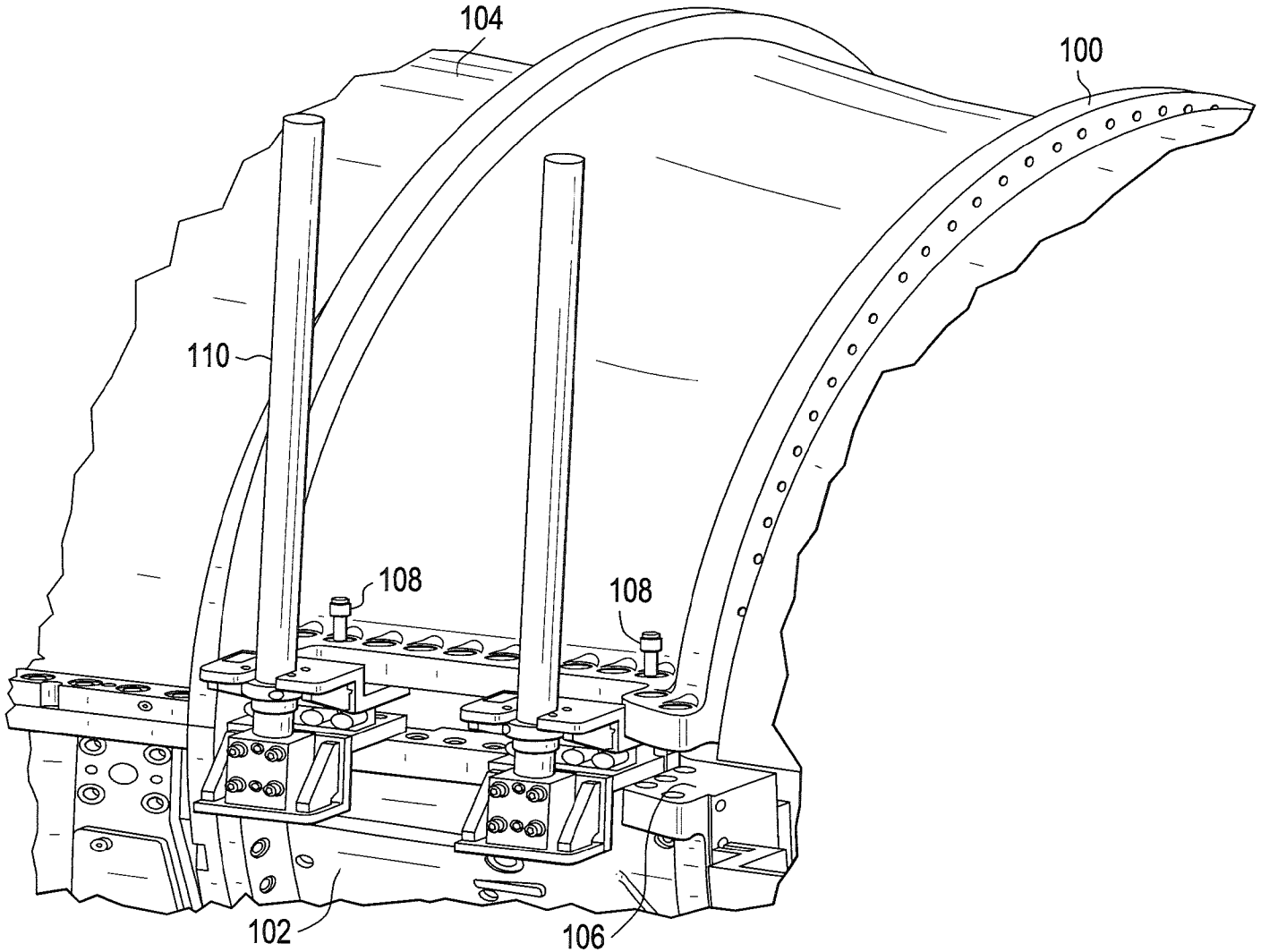
FIG. 1 is a perspective view of a portion of turbine including a system for lifting a casing section according to an embodiment of the present invention.

FIG. 1 shows an example of a system for lifting a casing section 100 according to one embodiment. The casing section 100 is a particular section that is to be removed. It shall be understood that the casing section 100 can be any section of a turbine or any other industrial machine. In the event that the casing section 100 is part of a turbine, the casing section 100 will typically form one half of a cylinder that surrounds a rotor (not shown). The other half of the cylinder is illustrated as lower casing section 102. When the turbine is operating the casing section 100 sets on and is coupled to the lower casing section 102.

In the event that the casing section 100 needs to be removed, the bolts or other fasteners (not shown) joining the casing section 100 to the lower casing section 102 are removed. In addition, any fastener that joins the casing section 100 to another section (e.g., adjacent casing section 104) are also removed.

In one embodiment, the casing section 100 includes one or more bolt holes 106 that include internal threads. To separate the casing section 100 from the lower casing section 102, one or more jacking screws 108 are screwed into the bolt holes 106. As the jacking screws 108 are turned, they contact the lower casing section 102 and cause the casing section 100 to separate from and rise above the lower casing section 102 in a known manner.

The jacking screws 108 typically do not provide a large enough separation from the lower casing section 102 to allow for repairs to be safely or effectively conducted. As described above, in the prior art a crane was typically utilized to remove the casing section 100 at this point.

In contrast, in embodiments of the present invention, one or more raising devices 110 are coupled to the casing section 100 and the lower casing section 102. The raising devices 110 can be coupled to the casing section 100 and the lower casing section 102, for example, via the bolt holes 106 in one embodiment. As illustrated, two raising devices 110 are on one side of the casing section 100 and, while not illustrated, two more raising devices 110 are utilized on the other side of the casing section 100. Of course, the number of raising devices 110 on each side is not limited to two. As such, embodiments of the present invention are directed to utilizing one or more raising devices on each side of the casing section 100.

As described in greater detail below, the raising devices 110 allow for the casing section 100 to be raised to a useful height for maintenance or to a height in which stanchions/supports may be inserted. In one embodiment, the supports 302, 502 (FIGS. 3 and 5) include rails or other mechanisms that allow the casing section 100 to be translated axially along the length of the machine or in a direction that is transverse thereto. In one embodiment, the supports 302, 502 do not include the rails.

Figure 2:
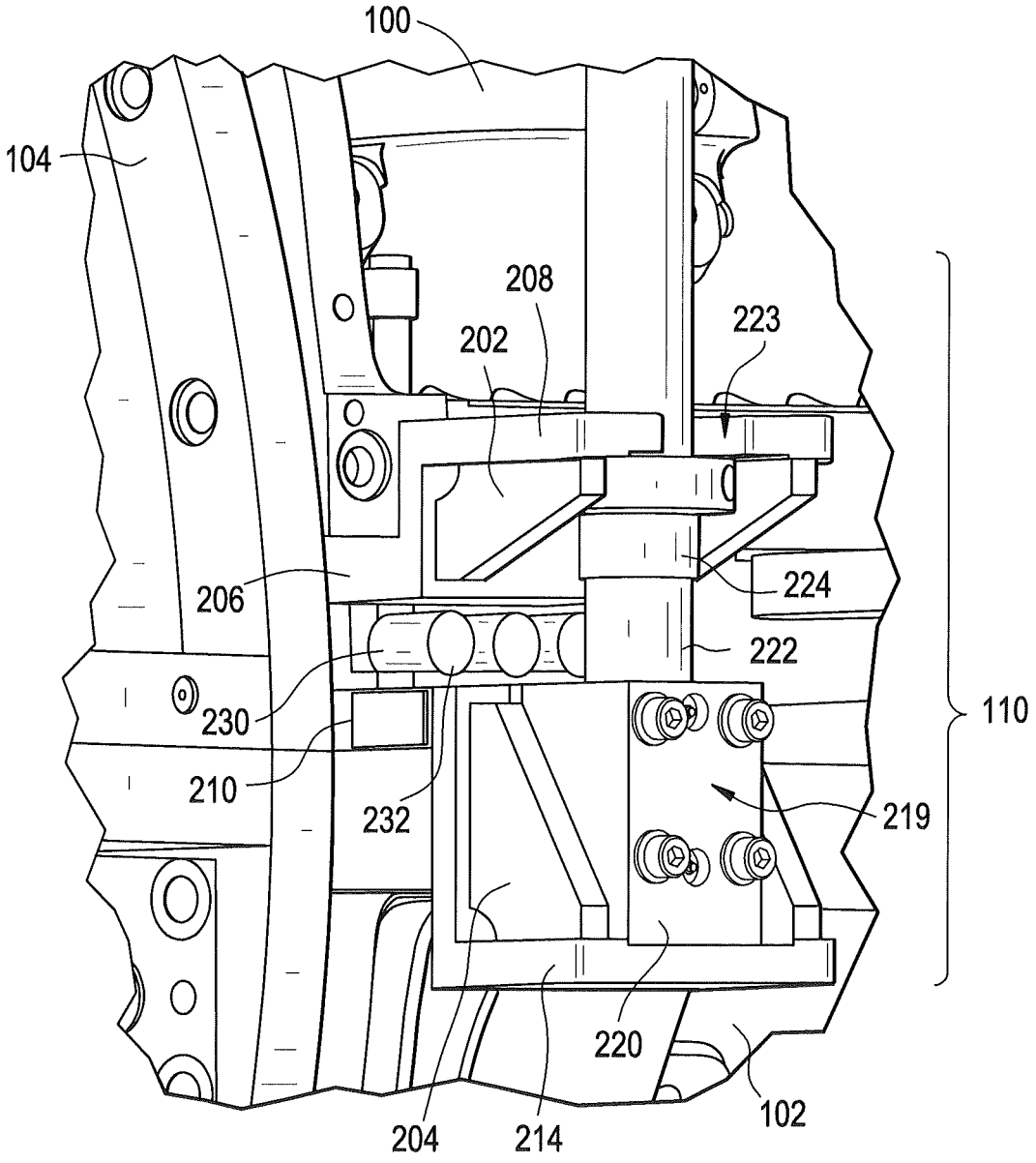
FIG. 2 illustrates a raising device according to the present invention.

FIG. 2 illustrates a raising device 110 according to one embodiment of the present invention. As illustrated, the raising device 110 is coupled to the casing section 100 and the lower casing section 102.

The raising device 110 includes first and second attachment members 202, 204. The raising device 110 also includes a jacking mechanism 219. In general, the first and second attachment members 202, 204 provide for a removable mechanical connection between the jacking mechanism 219 and the casing section 100 such that the jacking mechanism 219 may be employed to vertically displace the casing section 100 relative to the lower casing section 102.

In one embodiment, the first attachment member 202 couples to the casing portion 100 and the second attachment member 204 couples to the lower casing section 102. In more detail, the first attachment member 202 includes a first coupling region 206 configured to mate with and be coupled to the casing section 100. Similarly, the second attachment member 204 includes a second coupling region 210 configured to mate with and be coupled to the lower casing section 102. In one embodiment, the first and second coupling regions 206, 210 include holes formed therein that allow bolts or other fasteners to pass through such that the first and second coupling regions 206, 210 are securely attached, respectively, to the casing section 100 and the lower casing section 102.

As illustrated, the jacking mechanism 219 is a screw jack that includes a lead screw 222, a base 220 and collar 224. In one embodiment, the lead screw 222 is an ACME screw. As is known in the art, the lead screw 222 seats in the base 220 in such a manner that the lead screw 222 can rotate about its axis. Rotation of the lead screw 222 causes the collar 224 to move up or down along the lead screw 222. It shall be understood that other types of jacking mechanisms 219 could be utilized and the screw jack shown in FIG. 2 is merely one example.

The first attachment member 202 includes a first jacking mechanism connection portion 208 and the second attachment member 204 includes a second jacking mechanism connection portion 214 in the illustrated embodiment. In one embodiment, the first jacking mechanism connection portion 208 is configured to mate with the collar 224. In one embodiment, the first jacking mechanism connection portion 208 includes holes that allow bolts or other fastener to couple the first jacking mechanism connection portion 208 to the collar 224. In one embodiment, first jacking mechanism connection portion 208 includes a recess 223 that allows the lead screw 222 to be inserted or removed from the first jacking connection portion 208.

As illustrated, the second attachment member 204 includes a second jacking mechanism connection portion 214. In one embodiment, the second jacking mechanism connection portion 214 is configured to receive and support the base 220. It shall be understood that the second jacking mechanism connection portion 214 can include bolts or other fasteners to secure the base 220 therein in one embodiment.

In operation a motivating force is applied to the lead screw 222 when the first and second attachment members 202, 204 are attached to the casing section 100 and the lower casing section 102 and the jacking mechanism 219 is coupled to or otherwise supported in the first and second attachment members 202, 204. This force causes the casing section 100 to move vertically relative to the lower casing section 102.

In one embodiment, the first attachment member 202 includes a translation assembly 230. The translation assembly 230 illustrated in the FIG. 2 includes one or more rollers 232 that allow the casing section 100 to roll across a support as described below. It shall be understood that the translation assembly 230 can be configured to allow the casing section 100 to roll in any direction.

Figure 3:
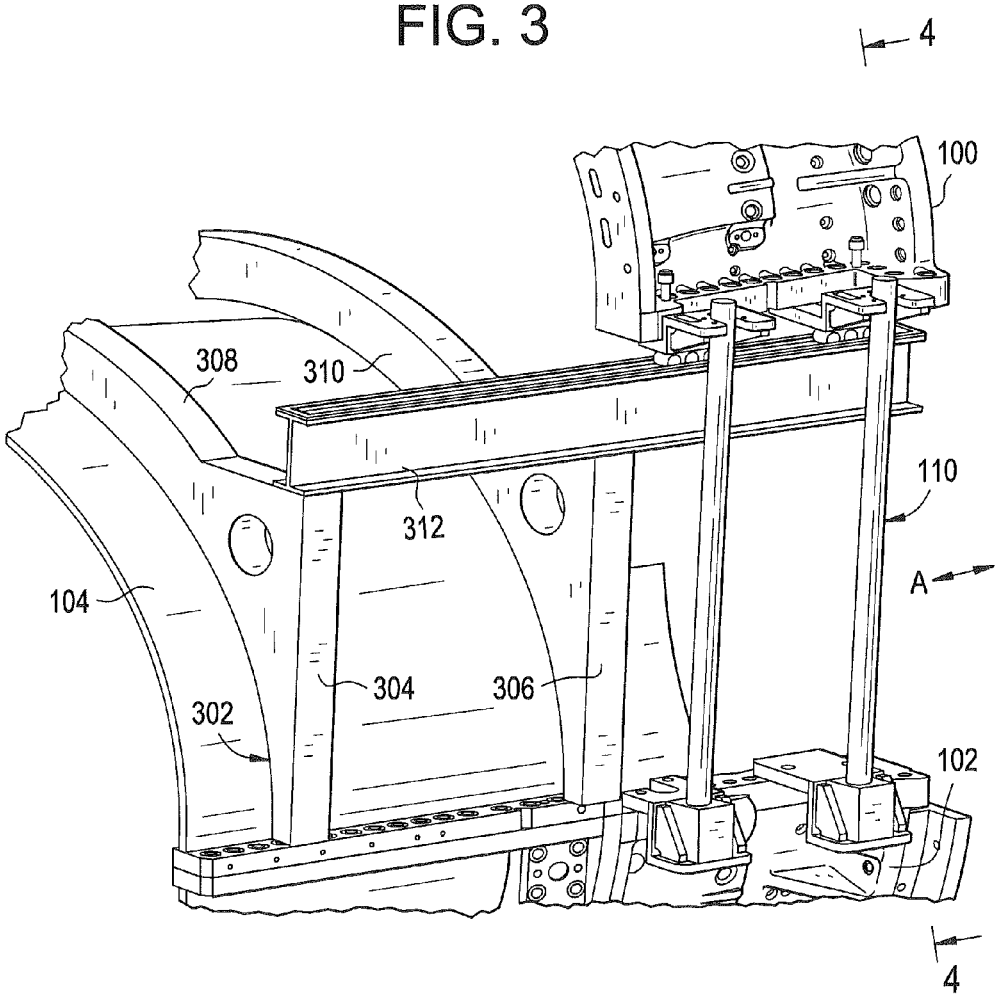
FIG. 3 illustrates an example of a support that may be utilized in moving a casing section in one embodiment.

FIG. 3 illustrates an example of support 302 according to one embodiment. The support shown in FIG. 3 allows, for example, the casing section 100 to be translated in an axial direction as indicated by arrow A. It shall be understood that in one embodiment, the first attachment member 202 of FIG. 2 includes the translation assembly 230 when the support 302 is utilized.

The support 302 includes one or more vertical supports 304, 306. The vertical supports 304, 306 are configured to set on an adjacent casing section 104. It shall be understood that a corresponding set of vertical supports may be arranged on an opposite side of the adjacent casing section 104 and coupled to the vertical supports 304, 306 by connection members 308, 310.

In one embodiment, a travel path is defined by a travel beam 312 that extends between the vertical supports 304, 306. In one embodiment, the travel beam extends beyond an outer edge of at least one of the vertical support 306, 308. In one embodiment, the casing section 100 is lifted to a desired height above the lower casing section 102. The support 302 is then placed such that it mates with at least a portion of the adjacent casing section 104. The casing section 100 may then be lowered onto the support 302, the jacking mechanisms 110 removed, and then translated in either direction along the length of the travel beam.

Figure 4:
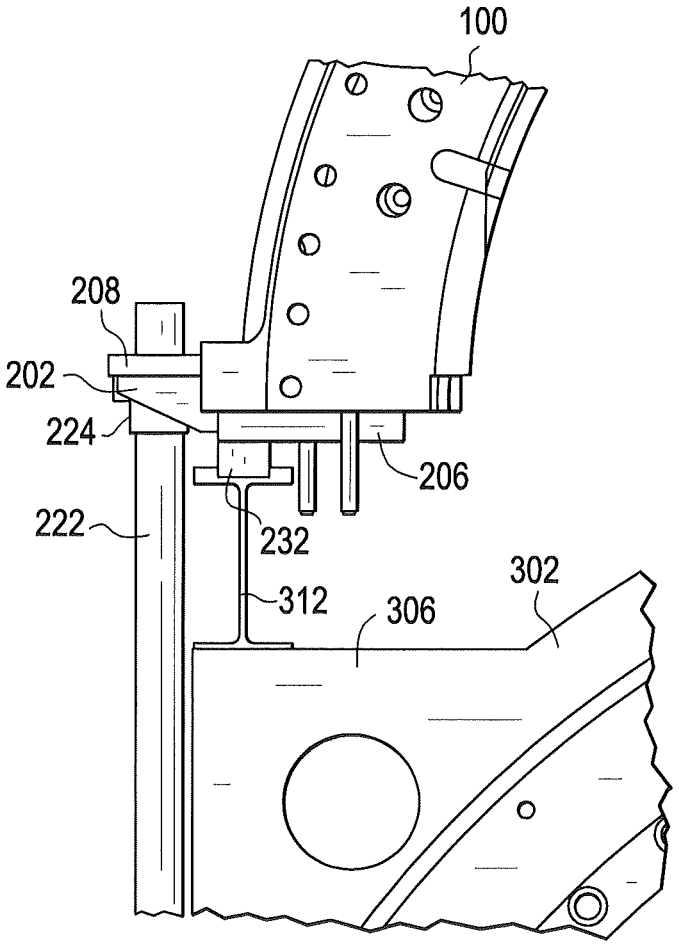
FIG. 4 is an end view of the support shown in FIG. 3 as it supports a casing section.

FIG. 4 shows an end view along lines 4-4 of FIG. 3. As illustrated, the casing section 100 is resting on the travel beam 312. As described above, the first attachment member 202 is coupled to the casing section 100 via the first coupling region 206 and is shown coupled to the collar 224 by the first jacking mechanism connection portion 208. Of course, the lead screw 222 and the collar 224 could be removed because the weight to the casing section 100 is being supported by the support 302. As will be appreciated, the casing section 100 can be moved along the travel beam 312 because of the presence of the roller 232.

Figure 5:
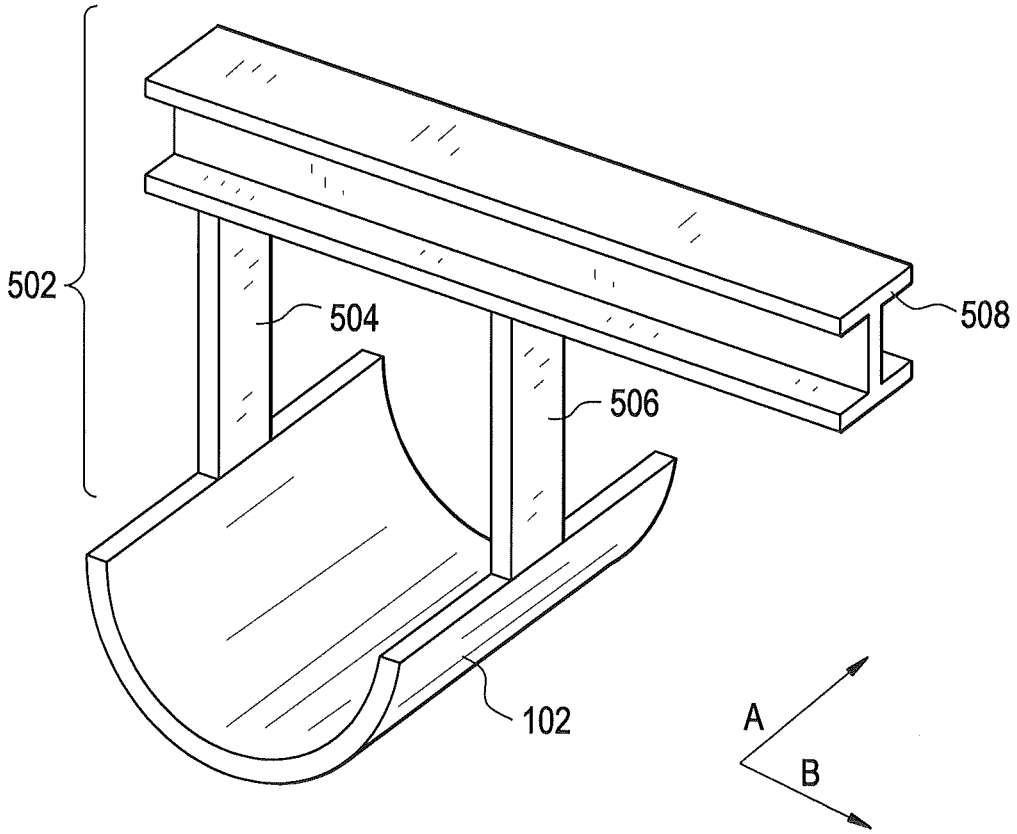
FIG. 5 illustrates an example of a support that may be utilized in moving a casing section in another embodiment.

FIG. 5 illustrates another embodiment of a support 502. In this embodiment, the support includes vertical supports 504, 506. These supports, in use, are arranged such that they are supported by different sides of the lower casing section 102 or by axially adjacent casings such as 104. The vertical supports 504, 506 are connected to and support at least one travel beam 508. The travel beam 508 allows the casing section (not shown) to travel in the transverse direction as shown by arrow B. It shall be understood that arrow B is perpendicular to the axial direction (arrow A) in one embodiment.

Either of the supports 302, 502 can be formed in separable pieces. In one embodiment, each piece can be moved by two or fewer individuals.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A machine casing section lift system comprising:

a first attachment member configured to attach to a machine casing section, the first attachment member including a first jacking mechanism connection portion;

a second attachment member configured to attach to a lower casing section that, in operation, is positioned below the machine casing section, the second attachment member including a second jacking mechanism connection portion; and a jacking mechanism to raise the machine casing section and having a collar configured to couple with the first jacking mechanism connection portion and a base configured to rest in the second jacking mechanism connection portion, wherein the collar abuts the first attachment member and the base being supported by the second attachment member, the collar being configured and disposed to act on the first attachment member to raise the machine casing section.

2. The machine casing section lift system of claim 1, wherein the jacking mechanism is a screw jack.

3. The machine casing section lift system of claim 1, further comprising:

a support having a portion placed between the machine casing section and the lower casing section.

4. The machine casing lift system of claim 3, wherein the support includes a travel beam that extends axially along a length of the machine.

5. The machine casing lift system of claim 4, wherein the travel beam is supported by one or more supports coupled to a section of the machine adjacent the machine casing section.

6. The machine casing lift system of claim 3, wherein the support includes a travel beam that extends along a transverse axis of the machine.

7. The machine casing lift system of claim 4, wherein the travel beam is coupled to one or more supports that are coupled to the lower section.

8. The machine casing lift system of claim 1, wherein the first attachment member includes a first attachment portion that attaches to the machine casing section.

9. The machine casing lift system of claim 1, wherein the first attachment member includes a translation assembly.

10. The machine casing lift system of claim 9, wherein the translation assembly includes one or more rollers that allow the first attachment member to traverse a surface while attached to the machine casing section.

11. The machine casing lift system of claim 1, wherein the machine casing section is part of a turbine.

12. The machine casing lift system of claim 11, wherein the turbine is selected from one of a gas turbine and a steam turbine.

13. A machine casing section transport system comprising:

one or more vertical supports configured to couple to a section of a machine;

a travel beam supported by the one of the vertical supports; and a first attachment member configured to couple to a first casing section of the machine, the first attachment member including a translation assembly that allows it to traverse the travel beam.

14. The machine casing section transport system of claim 13, wherein the one or more vertical supports include first and second vertical supports and wherein the first and second vertical supports are coupled to the travel beam and are located on a same side of a central axis of the machine.

15. The machine casing section transport system of claim 14, further comprising third and fourth vertical supports located on an opposite side of the central axis than the first and second vertical supports.

16. The machine casing section transport system of claim 15, wherein the first vertical support is connected to the third vertical support by a first connection member that extends over a second casing section and the second vertical support is connected to the fourth vertical support by a second connection member that extends over the second casing section.

17. The machine casing section transport system of claim 13, wherein the one or more vertical supports includes first and second vertical supports and wherein the first and second vertical beam supports are coupled to the travel beam and are located on different sides of a central axis of the machine.

18. The machine casing section transport system of claim 17, further comprising third and fourth vertical supports located on opposite sides of the central axis.

19. The machine casing section transport system of claim 18, wherein the first, second, third and fourth vertical supports are all coupled to a second casing section located below the first casing section.

20. The machine casing section transport system of claim 13, wherein the machine is selected from one of a gas turbine and a steam turbine.

* * * * *